US008989647B2

(12) United States Patent
Toshiyuki

(10) Patent No.: US 8,989,647 B2
(45) Date of Patent: Mar. 24, 2015

(54) TONER CONVEYING UNIT FOR COLLECTING TONER AND CONVEYING TONER TO TONER STORAGE CONTAINER

(71) Applicants: Casio Computer Co., Ltd., Shibuya-ku, Tokyo (JP); Casio Electronics Manufacturing Co., Ltd., Iruma-shi, Saitama (JP)

(72) Inventor: Hirokazu Toshiyuki, Fussa (JP)

(73) Assignees: Casio Electronics Manufacturing Co., Ltd., Saitama (JP); Casio Computer Co., Ltd., Tokyo (JP)

( * ) Notice: Subject to any disclaimer, the term of this patent is extended or adjusted under 35 U.S.C. 154(b) by 61 days.

(21) Appl. No.: 13/782,603

(22) Filed: Mar. 1, 2013

(65) Prior Publication Data

US 2013/0251433 A1 Sep. 26, 2013

(30) Foreign Application Priority Data

Mar. 21, 2012 (JP) ..... 2012-064580

(51) Int. Cl.
*G03G 21/12* (2006.01)
*G03G 21/10* (2006.01)

(52) U.S. Cl.
CPC ..... *G03G 21/10* (2013.01); *G03G 21/105* (2013.01)
USPC ..... 399/360

(58) Field of Classification Search
CPC ..... G03G 21/105
USPC ..... 399/360
See application file for complete search history.

(56) References Cited

U.S. PATENT DOCUMENTS 6,085,062 A * 7/2000 Mizuishi et al. ..... 399/358
7,221,880 B2 * 5/2007 Jeong et al. ..... 399/360 X
8,131,165 B2 3/2012 Yamaguchi et al.

(Continued)

FOREIGN PATENT DOCUMENTS

JP 2002-311712 A 10/2002
JP 2003-186289 A 7/2003

(Continued)

OTHER PUBLICATIONS

Japanese Office Action dated Jan. 14, 2014 (and English translation thereof) in counterpart Japanese Application No. 2012-064580.

(Continued)

*Primary Examiner* — Sandra Brase
(74) *Attorney, Agent, or Firm* — Holtz, Holtz, Goodman & Chick PC

(57) ABSTRACT

A toner conveying unit includes a first toner conveying passage, a second toner conveying passage, a conveying member, a crank, and a vertical slide member. The first toner conveying passage includes a receiving port and allows toner to fall down from the receiving port. The second toner conveying passage joins a lower portion of the first toner conveying passage. The conveying member is provided in the second toner conveying passage and conveys the toner in a predetermined direction while rotating. The crank is provided in the second toner conveying passage below the first toner conveying passage and is connected to the conveying member. The vertical slide member is connected to the crank, is inserted into the first toner conveying passage, and is formed so as to come into slide contact with an inner wall of the first toner conveying passage.

11 Claims, 4 Drawing Sheets

(56) References Cited

U.S. PATENT DOCUMENTS

| | | | | |
|---|---|---|---|---|
| 8,346,151 | B2 | 1/2013 | Akaike et al. | |
| 2009/0324294 | A1 * | 12/2009 | Ichikawa et al. | 399/258 |
| 2010/0080637 | A1 | 4/2010 | Yamaguchi et al. | |
| 2010/0239340 | A1 | 9/2010 | Akaike et al. | |

FOREIGN PATENT DOCUMENTS

| | | | |
|---|---|---|---|
| JP | 2007-058121 | A | 3/2007 |
| JP | 2009-122362 | A | 6/2009 |
| JP | 2010-078797 | A | 4/2010 |
| JP | 2010-085485 | A | 4/2010 |
| JP | 2010-197971 | A | 9/2010 |
| JP | 2010-224004 | A | 10/2010 |
| JP | 2011-039569 | A | 2/2011 |

OTHER PUBLICATIONS

Japanese Office Action dated Apr. 8, 2014 in counterpart Japanese Application No. 2012-064580.

* cited by examiner

TONER CONVEYING UNIT FOR COLLECTING TONER AND CONVEYING TONER TO TONER STORAGE CONTAINER

CROSS-REFERENCE TO RELATED APPLICATION

This application claims priority based on Japanese Patent Application No. 2012-064580, filed on Mar. 21, 2012, the entire contents of which are incorporated by reference herein.

BACKGROUND OF THE INVENTION

1. Field of the Invention

The present invention relates to a toner conveying unit, and more particularly, to a toner conveying unit that collects waste toner discharged from a cleaner for a transfer belt and cleaners for photoreceptor drums of an image forming apparatus and efficiently conveys the waste toner to a toner storage container.

2. Description of the Related Art

In the past, there has been an electrophotographic image forming apparatus. The electrophotographic image forming apparatus includes photoreceptor drums that carry toner images developed into at least electrostatic latent images and a transfer belt that directly or indirectly transfers the toner images carried by the photoreceptor drums to a recording medium.

Since residual toner, which is not transferred to the transfer belt, is generated on the photoreceptor drums, drum cleaners for collecting this residual toner as waste toner are disposed. Further, since residual toner, which is not transferred to the recording medium, is generated even on the transfer belt, a belt cleaner for collecting this residual toner as waste toner is disposed.

The waste toner, which is collected by the drum cleaners or the belt cleaner, is further collected into a waste toner storage container through waste toner conveying passages. The waste toner storage container, which is full of the collected waste toner, is separated and discarded from the image forming apparatus, and a new waste toner storage container is mounted on the image forming apparatus.

Meanwhile, when not only waste toner but also toner is generally conveyed, a conveying passage is divided into a horizontal conveying passage and a vertical conveying passage so that the toner or the waste toner is conveyed to the final destination while being successively conveyed in the horizontal and vertical directions.

For example, even when a developing unit is replenished with toner from a toner cartridge, the conveying passage is divided into the horizontal and vertical directions. Further, toner is forcibly conveyed in the horizontal direction by a screw member, but free fall is often used for the conveyance of toner in the vertical direction.

In general, toner is originally a non-magnetic material, but is electrostatically charged with a predetermined polarity due to the agitation performed by an agitating member, friction generated from blades, or the like for the convenience of development. Accordingly, at a point where the direction of the conveying passage is changed into a vertical direction from a horizontal direction or into a horizontal direction from a vertical direction, a toner pile is apt to be formed by electrostatic adsorption at a portion where a conveying member, an agitating member, or the like is not provided.

In JP-A-2010-078797, a crushing member is disposed at a connecting portion between a vertical passage of a toner cartridge and a vertical passage of a developing unit so as to prevent a toner pile from being formed in the vertical passages. Meanwhile, in the JP-A-2010-078797, the crushing member is disposed close to the toner cartridge, that is, the side from which toner is supplied. A hook portion is formed at an end portion of the crushing member, and the hook portion is rotatably mounted on a crank portion of an agitator that agitates toner and conveys the toner to the vertical passage.

Accordingly, the crushing member expands and contracts with the rotation of the agitator that agitates toner and conveys the toner to the vertical passage. That is, when the crank portion of the agitator is positioned distant from the vertical passage, the crushing member is in an extension state. When the crank portion of the agitator is positioned close to the vertical passage, the crushing member is in a contraction state. The crushing member crushes hardened toner by repeatedly expanding and contracting as described above.

However, an engagement portion is formed at an end portion opposite to the hook portion of the crushing member of JP-A-2010-078797, and the crushing member is fixed to a wall of a supply passage when the engagement portion is engaged with a recess formed on the inner wall of the vertical passage. For this reason, there is a problem in that a toner pile adhering to the inner wall surface of the vertical passage cannot be crushed.

Further, if a form of conveying toner disclosed in JP-A-2010-078797 is applied to a waste toner conveying mechanism, the crushing member is disposed for the drum cleaner of each developing unit that is the side from which waste toner is supplied. For this reason, there is a problem in that the structure of an image forming unit becomes complicated and an increase in cost is caused due to the increase in the number of parts.

Furthermore, like toner that contributes to development and transfer, a bias voltage is applied to waste toner at the time of both development and transfer. That is, waste toner has strong electric charges unlike toner which is replenished from the toner cartridge and to which a bias voltage is not yet applied.

The waste toner, which has strong electric charges as described above, starts to adhere to the inner surface of a lower vertical wall from a receiving port, at which the direction of the waste toner conveying passage is changed into a vertical direction from a horizontal direction, due to an electrostatic force. The amount of the waste toner, which starts to adhere, is gradually increased and the waste toner becomes staying toner. Moreover, deposited waste toner forms a waste toner pile, so that the receiving port is completely clogged.

The waste toner, which is sequentially accumulated from the inner wall of the receiving port to the center of the inner wall as described above, is not conveyed despite the rotation of a conveying screw that is provided on the side from which toner is supplied. Further, the waste toner, which does not have a destination, is accumulated in a waste toner discharge port and the cleaner.

As the waste toner is accumulated, the waste toner overflows to the outside of the cleaner and causes a defective image. Furthermore, the rotation failure of a waste toner discharge/conveying screw is caused by the pressure of the accumulated waste toner. In the end, a disadvantageous state such as unrecoverable breakage is caused.

Since the waste toner has strong electric charges as described above, the waste toner is apt to adhere to the inner wall of the conveying passage in the conveying passage that is used to collect the waste toner and a waste toner pile is apt to be easily formed. It is not possible to prevent the formation of this toner pile through the disposition of the same crushing member as the crushing member that is disposed for the toner replenished from the toner cartridge.

The invention has been made to solve the above-mentioned problems in the related art, and an object of the invention is to provide a waste toner conveying unit that collects waste toner discharged from a cleaner for a transfer belt and cleaners for photoreceptor drums of an image forming apparatus and efficiently conveys the waste toner to a waste toner storage container without forming a waste toner pile in a conveying passage through which the waste toner is conveyed.

BRIEF SUMMARY OF THE INVENTION

According to one embodiment of this invention, a toner conveying unit includes a first toner conveying passage, a second toner conveying passage, a conveying member, a crank, and a vertical slide member. The first toner conveying passage includes a receiving port and allows toner to fall down from the receiving port. The second toner conveying passage joins a lower portion of the first toner conveying passage. The conveying member is provided in the second toner conveying passage and conveys the toner in a predetermined direction while rotating. The crank is provided in the second toner conveying passage below the first toner conveying passage and is connected to the conveying member. The vertical slide member is connected to the crank, is inserted into the first toner conveying passage, and is formed so as to come into slide contact with an inner wall of the first toner conveying passage.

DETAILED DESCRIPTION OF THE INVENTION

An embodiment of the invention will be described in detail below with reference to the drawings.

First Embodiment

Figure 1:
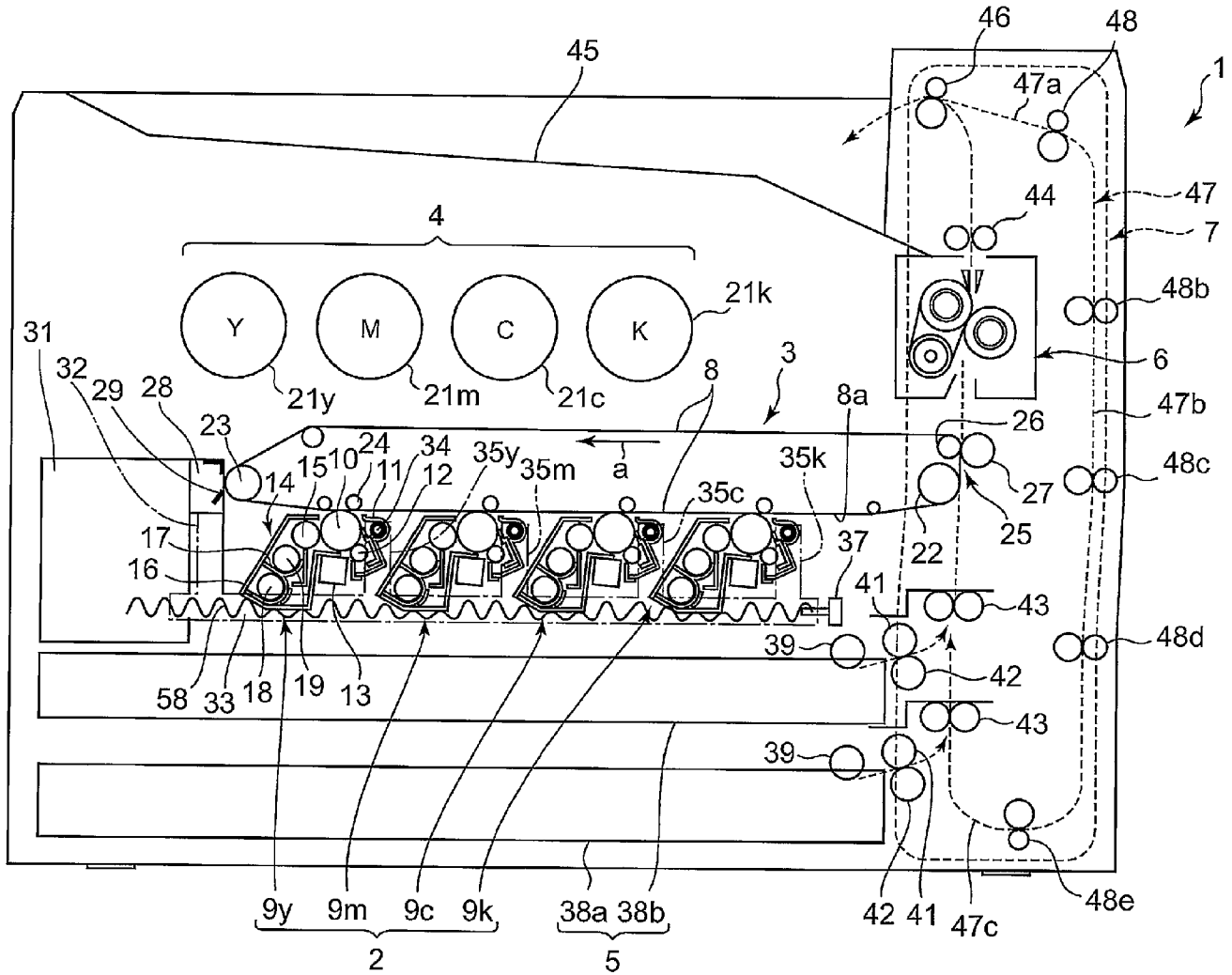
FIG. 1 is a cross-sectional view illustrating the internal structure of a full color image forming apparatus (a printer or an apparatus body) that is provided with a waste toner conveying unit according to a first embodiment of the invention.

FIG. 1 is a cross-sectional view illustrating the internal structure of a full color image forming apparatus (hereinafter, referred to as a printer or an apparatus body) 1 that is provided with a waste toner conveying unit 50 according to a first embodiment.

A printer 1 shown in FIG. 1 is an electrophotographic and secondary transfer tandem-type color image forming apparatus. The printer 1 includes an image forming section 2, a transfer belt unit 3, a toner supply section 4, a sheet feeding section 5, a belt type fixing unit 6, and a conveying unit 7 for duplex printing.

The image forming section 2 has a structure where four image forming units 9 (9*k*, 9*c*, 9*m*, and 9*y*) are arranged side by side from the right side to the left side in FIG. 1 in multi-stages so as to come into contact with a lower traveling portion-surface 8*a* of a transfer belt 8 of the transfer belt unit 3. The image forming section 2 is held by a frame of a body of the printer 1 so as to be capable of moving up and down between a printing position shown in FIG. 1 and a maintenance position positioned below the printing position.

The three image forming units 9*c*, 9*m*, and 9*y*, which are provided on the upstream side (the left side in FIG. 1), among the four image forming units 9 (9*k*, 9*c*, 9*m*, and 9*y*) form unicolor images that are made of a cyan (C) toner, a magenta (M) toner, and a yellow (Y) toner corresponding to three primary colors of subtractive color mixture. The image forming unit 9*k* forms a monochrome image made of a black (K) toner that is mainly used for letters, dark portions of images, or the like.

The respective image forming units 9 (9*k*, 9*c*, 9*m*, and 9*y*) have the same structure except for the colors of the toners that are used to develop images. Accordingly, the structure of the image forming unit 9*y* for a yellow (Y) toner will be described below by way of example.

The image forming units 9 (9*k*, 9*c*, 9*m*, and 9*y*) are provided with photoreceptor drums 10 at the uppermost portion thereof. The peripheral surface of the photoreceptor drum 10 is made of, for example, an organic photoconductive material. A drum cleaner 11, a charging roller 12, an optical writing head 13, and a developing roller 15 of a developing unit 14 are disposed so as to surround the peripheral surface of the photoreceptor drum 10.

The developing unit 14 includes the developing roller 15, a housing 16 that covers the external portion of the developing unit, a partition wall 17 that is provided in the developing unit, a first agitating/conveying screw 18, and a second agitating/conveying screw 19. Although not particularly shown, each of the first and second agitating/conveying screws 18 and 19 includes a screw shaft and fins that are formed integrally with the screw shaft and rotate.

As shown by K, C, M, and Y in FIG. 1, one of a black (K) toner, a cyan (C) toner, a magenta (M) toner, and a yellow (Y) toner is supplied to the developing unit 14 from one of toner replenishing containers 21 (21*k*, 21*c*, 21*m*, and 21*y*) of the toner supply section 4.

The transfer belt unit 3 includes the above-mentioned endless transfer belt 8 that extends in the shape of a flat loop in the horizontal direction of FIG. 1 substantially at the center of the apparatus body, and a driving roller 22 and a driven roller 23 on which the transfer belt 8 is stretched and which circularly moves the transfer belt 8 in the counterclockwise direction shown by an arrow a of FIG. 1.

A primary transfer roller 24 is assembled integrally with the unit on the transfer belt 8. The primary transfer roller 24 comes into press contact with the photoreceptor drum 10 with the transfer belt 8 interposed therebetween, and directly transfers (primarily transfers) a toner image to the lower traveling portion-surface 8*a* of the transfer belt 8 that is circularly moved on the lower side.

The transfer belt 8 is conveyed to a secondary transfer section 25 in order to further transfer (secondarily transfer) the toner image to a sheet. The secondary transfer section 25 includes a transfer auxiliary roller 26 that is disposed on the downstream side (the upper side in FIG. 1) so as to be adjacent to the driving roller 22, and a secondary transfer roller 27 that comes into press contact with the transfer auxiliary roller 26 with the transfer belt 8 interposed therebetween.

A belt cleaner 28 is disposed on the transfer belt 8. The belt cleaner 28 includes a cleaning plate 29 that comes into contact with the surface of the transfer belt 8 that is stretched by the driven roller 23. Further, a waste toner storage container 31 is detachably provided adjacent to the left and lower portions of the belt cleaner 28.

The belt cleaner 28 scrapes and removes waste toner, which remains on the surface of the transfer belt 8, by the cleaning plate 29 and sends the waste toner to a waste toner receiving port, which is formed on the front surface of the upper portion of a vertical belt-waste-toner conveying passage 32 among two or more of the first toner conveying passages, by a conveying screw (not shown).

The vertical belt-waste-toner conveying passage 32 is disposed on the back side of the transfer belt unit 3 in the depth direction of the drawing (at the rear portion of the apparatus body 1), and a lower opening of the vertical belt-waste-toner conveying passage 32 is connected to an upper opening of the second toner conveying passage 33 which is a horizontal waste-toner conveying passage that is disposed at the rear portion of the apparatus body 1 likewise.

Although the description is slightly reversed, the drum cleaner 11 of each of the image forming units 9 (9*k*, 9*c*, 9*m*, and 9*y*) includes a waste toner discharging screw 34 therein. The waste toner discharging screws 34 convey waste toner, which is deposited on the drum cleaner 11, to the rear portion of the apparatus body 1 and send the waste toner to waste toner receiving ports that are formed on the front surfaces of the upper portions of the vertical drum-waste-toner conveying passages 35 (35*y*, 35*m*, 35*c*, and 35*k*) among two or more of the first toner conveying passages.

The respective vertical drum-waste-toner conveying passages 35 (35*y*, 35*m*, 35*c*, and 35*k*) are disposed at the rear portion of the apparatus body 1, and lower openings of the respective vertical drum-waste-toner conveying passages 35 are connected to the upper opening of the second toner conveying passage 33 as described in detail below.

The second toner conveying passage 33 is provided with a conveying member 58 therein. A start end of the conveying member 58 in a conveying direction is connected to a rotational drive gear 37 that is a driving source, and an end of the conveying member 58 in the conveying direction is disposed in the waste toner storage container 31 together with the end portion of the second toner conveying passage 33 that is connected to the lower surface of the waste toner storage container 31.

The conveying member 58 is rotated by a driving force that is obtained from the rotational drive gear 37. The conveying member 58 may be a rotating shaft where spiral blades are fixed to the outer peripheral surface of the rotating shaft, and may have the shape of a coil.

Further, the toner supply section 4 is detachably provided with the above-mentioned four toner replenishing containers 21 (21*y*, 21*m*, 21*c*, and 21*k*) that are disposed above an upper traveling portion of the transfer belt 8. A yellow (Y) toner, a magenta (M) toner, a cyan (C) toner, and a black (K) toner are stored in the four toner replenishing containers 21 as described above.

These four toner replenishing containers 21 are connected to the developing units 14 of the image forming units 9, which correspond to the respective toner replenishing containers 21, through toner supply passages that are connected to toner supply ports of mounting portions, although the toner supply passages are not shown in FIG. 1 since they are being hidden on the back side of the transfer belt unit 3.

Although not particularly shown, the toner supply section 4 is held by the frame of the body of the printer 1 so as to be capable of moving up and down between the printing position shown in FIG. 1 and the maintenance position positioned below the printing position.

The sheet feeding section 5 includes two sheet feeding cassettes 38 (38*a* and 38*b*) that are disposed in, for example, two stages, that is, the upper and lower stages. A sheet ejecting roller 39, a feeding roller 41, a separation roller 42, and a pair of standby conveying rollers 43 are disposed near each of sheet feeding ports (the right side in FIG. 1) of the two sheet feeding cassettes 38. Meanwhile, the number of the sheet feeding cassettes 38 is not limited to two. The number of the sheet feeding cassettes 38 may be one or three or more.

The above-mentioned secondary transfer section 25, which includes the transfer belt 8, the transfer auxiliary roller 26, and the secondary transfer roller 27 and transfers the toner image to a sheet, is formed in the sheet conveying direction of the pairs of standby conveying rollers 43 (above the pairs of standby conveying rollers 43 in the vertical direction of FIG. 1).

The belt type fixing unit 6 is disposed on the downstream side (upper side in FIG. 1) of the secondary transfer section 25; and a pair of discharging rollers 44, which discharges the sheet to which the toner image has been fixed from the belt type fixing unit 6, and a pair of sheet discharge rollers 46, which discharges the discharged sheet to a discharge tray 45 formed on the upper surface of the apparatus, are provided on the downstream side of the belt type fixing unit 6.

The conveying unit 7 for duplex printing also functions as an opening/closing member of which the outer surface (the right outer surface in FIG. 1) opens or shields the inside of the printer 1 to or from the outside from the side surface.

The conveying unit 7 for duplex printing includes a return passage 47 that includes a start return passage 47*a*, an intermediate return passage 47*b*, and an end return passage 47*c*. The start return passage 47*a* diverges from a portion immediately in front of the pair of sheet discharge rollers 46 to the right side in the horizontal direction of FIG. 1. The intermediate return passage 47*b* is bent downward from the start return passage 47*a*. The end return passage 47*c* is bent to the left side opposite to the above-mentioned side in the horizontal direction, and finally inverts a return sheet.

Further, five pairs of return rollers 48 (48*a*, 48*b*, 48*c*, 48*d*, and 48*e*) are disposed on the return passage 47. An outlet of the end return passage 47*c* is joined to a conveying passage that is directed to the pair of standby conveying rollers 43 corresponding to the lower sheet feeding cassette 38*a* of the sheet feeding section 5.

Figure 2:
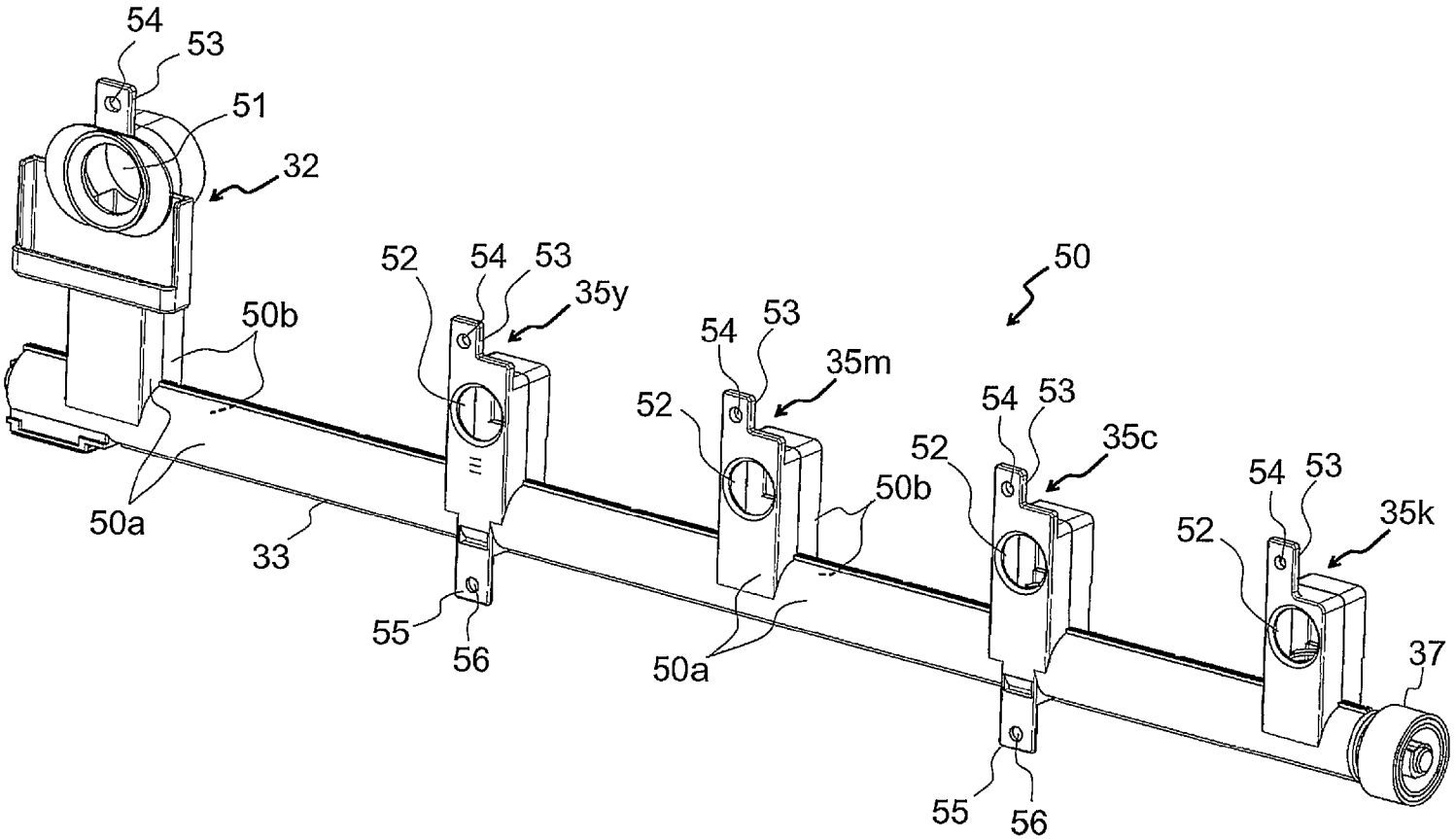
FIG. 2 is a perspective view showing the waste toner conveying unit alone immediately after the waste toner conveying unit according to the first embodiment is separated from a mounting portion of the printer or immediately before the waste toner conveying unit according to the first embodiment is mounted on the mounting portion.

FIG. 2 is a perspective view showing the waste toner conveying unit 50 alone immediately after the waste toner conveying unit 50 according to the first embodiment is separated from a mounting portion of the printer 1 or immediately before the waste toner conveying unit 50 according to the first embodiment is mounted on the mounting portion. Meanwhile, in FIG. 2, the same portions as the portions of FIG. 1 are denoted by the same reference numerals as the reference numerals of FIG. 1.

The waste toner conveying unit 50 shown in FIG. 2 includes the second toner conveying passage 33 that is formed of a pipe horizontally extending at the rear portion of the apparatus body 1. The vertical drum-waste-toner conveying passages 35 (35*y*, 35*m*, 35*c*, and 35*k*) are integrally formed so as to be connected to the second toner conveying passage 33 at the positions corresponding to the drum cleaners 11 of the image forming units 9 (9*k*, 9*c*, 9*m*, and 9*y*) shown in FIG. 1.

Furthermore, the vertical belt-waste-toner conveying passage 32 is also integrally formed so as to be connected to the second toner conveying passage 33 at the position corresponding to the belt cleaner 28 of the transfer belt unit 3 shown in FIG. 1.

First toner conveying passages of the embodiment include the vertical belt-waste-TONER conveying passage 32 and the vertical drum-waste-toner conveying passages 35 (35*y*, 35*m*, 35*c*, and 35*k*). Waste toner receiving ports 51 and 52 are formed on the front surfaces of the upper portions of the vertical belt-waste-toner conveying passage 32 and the vertical drum-waste-toner conveying passages 35 (35*y*, 35*m*, 35*c*, and 35*k*).

Moreover, upper mounting portions 53 to be mounted on the frame of the apparatus body are formed above the waste toner receiving ports 51 and 52 together with screw holes 54. In addition, lower mounting portions 55 are formed, on the same plane as the upper mounting portions 53, below the vertical drum-waste-toner conveying passage 35*y* and the vertical drum-waste-toner conveying passage 35*c* of the waste toner conveying unit 50 together with screw holes 56.

The waste toner conveying unit 50 is fixed to the frame of the apparatus body 1 by screw bolts (not shown), which are inserted into the screw holes 54 and 56, with the upper and lower mounting portions 53 and 55 interposed therebetween. At this time, the waste toner receiving ports 51 and 52 are engaged with waste toner discharge ports that are connected to the corresponding cleaners.

Further, the vertical belt-waste-toner conveying passage 32 allows waste toner, which is discharged from the belt cleaner 28 for the transfer belt 8 and conveyed in the horizontal direction, to free fall down from the waste toner receiving port 51. Furthermore, the vertical drum-waste-toner conveying passages 35 (35*y*, 35*m*, 35*c*, and 35*k*) allow waste toner, which is discharged from the drum cleaners 11 of the image forming units 9 (9*k*, 9*c*, 9*m*, and 9*y*) and conveyed in the horizontal direction, to free fall down from the waste toner receiving ports 52.

The waste toner conveying unit 50 is formed of front and rear structural portions 50*a* and 50*b* that are separately molded and bonded to each other after being molded.

Figure 3B:
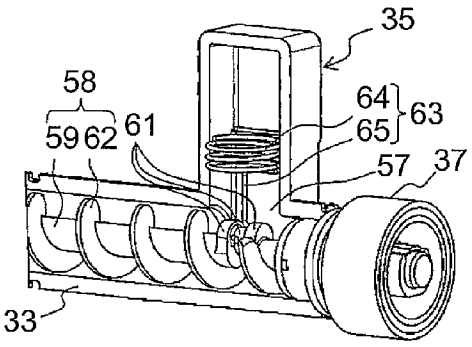
FIG. 3B is an enlarged view of a portion that is surrounded by a broken line circle b of FIG. 3A.
Figure 3A:
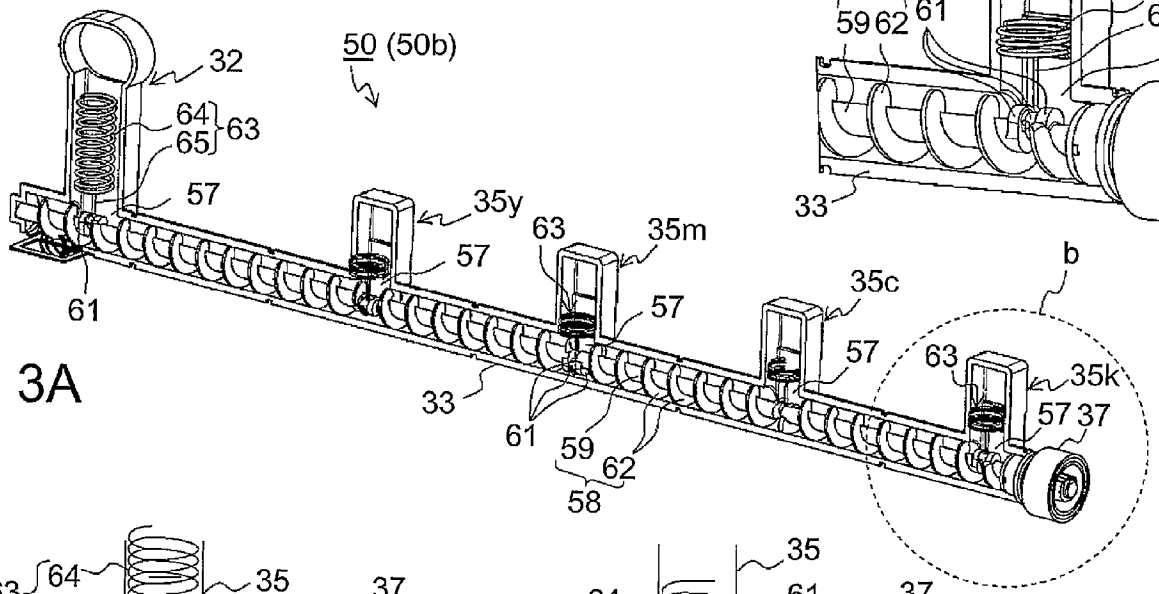
FIG. 3A is a perspective view showing the internal structure of the waste toner conveying unit shown in FIG. 2 from which only a front structural portion has been removed.
Figure 3D:
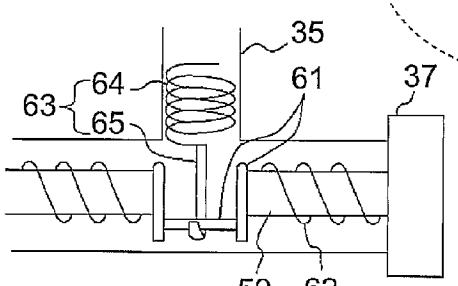
FIG. 3D is a view showing the portion of FIG. 3B when the portion of FIG. 3B is seen from the front, and shows a state where the crank is positioned on the lower side.
Figure 3C:
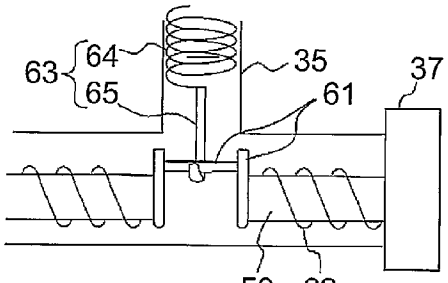
FIG. 3C is a view showing the portion of FIG. 3B when the portion of FIG. 3B is seen from the front, and shows a state where a crank is positioned on the upper side.

FIG. 3A is a perspective view showing the internal structure of the waste toner conveying unit 50 shown in FIG. 2 from which only the front structural portion 50*a* has been removed, and FIG. 3B is an enlarged view of a portion that is surrounded by a broken line circle b of FIG. 3A. FIG. 3C is a view showing the portion of FIG. 3B when the portion of FIG. 3B is seen from the front, and shows a state where a crank is positioned on the upper side. FIG. 3D is a view showing the portion of FIG. 3B when the portion of FIG. 3B is seen from the front, and shows a state where the crank is positioned on the lower side.

Figure 4:
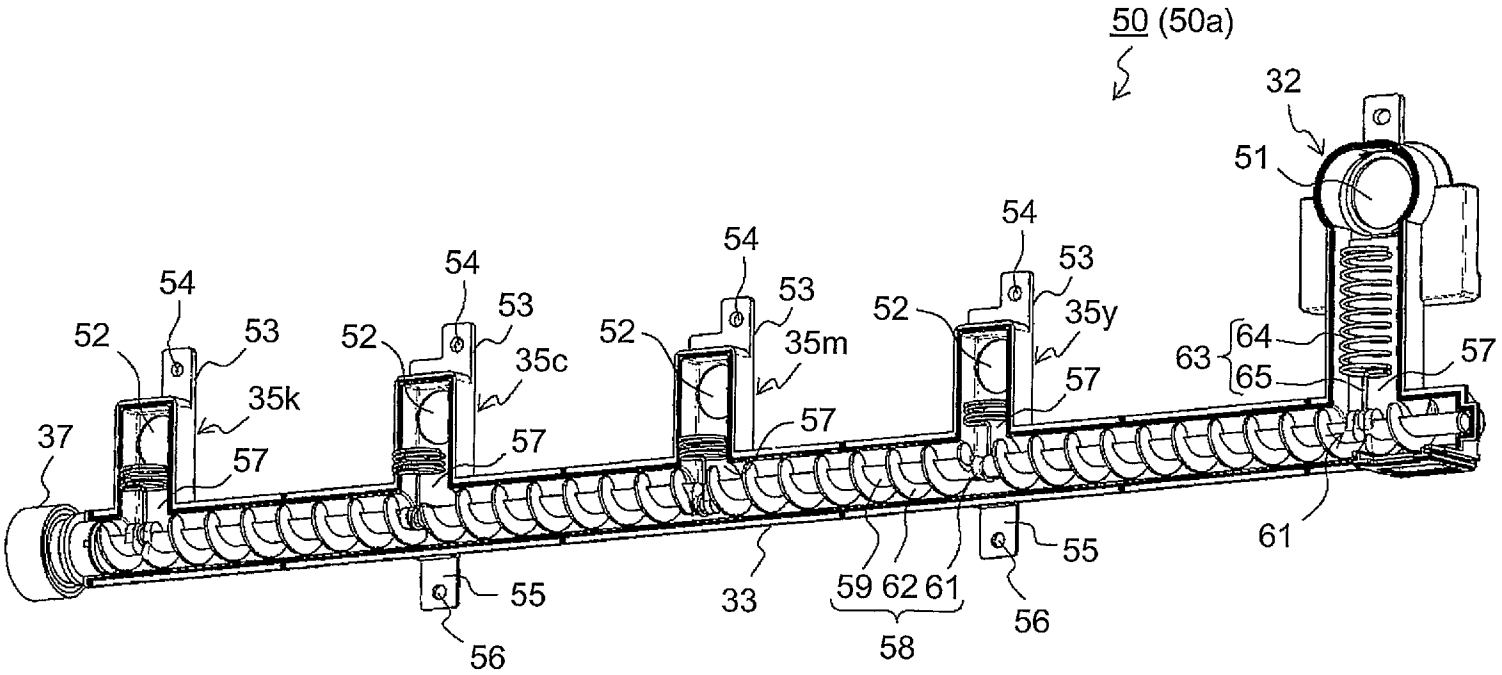
FIG. 4 is a perspective view showing the internal structure of the waste toner conveying unit shown in FIG. 2 from which only a rear structural portion has been removed.

FIG. 4 is a perspective view showing the internal structure of the waste toner conveying unit 50 shown in FIG. 2 from which only the rear structural portion 50*b* has been removed. Since the direction in which the waste toner conveying unit is seen is reversed, the left and right sides in FIGS. 3A and 3B are reversed to those in FIG. 4. Meanwhile, in FIGS. 3A, 3B, and 4, the same portions as the portions of FIG. 2 are denoted by the same reference numerals as the reference numerals of FIG. 2.

As shown in FIGS. 3A, 3B, and 4, the waste toner conveying unit 50 joins the lower portions of the vertical drum-waste-toner conveying passages 35 (35*y*, 35*m*, 35*c*, and 35*k*) and the vertical belt-waste-toner conveying passage 32, and waste toner collecting ports 57, which are used to collect the waste toner free falling down through the vertical drum-waste-toner conveying passages 35 (35*y*, 35*m*, 35*c*, and 35*k*) and the vertical belt-waste-toner conveying passage 32, are formed in the waste toner conveying unit 50.

The conveying member 58, which conveys the waste toner collected at the waste toner collecting ports 57 to the waste toner storage container 31 (see FIG. 1), is provided in the second toner conveying passage 33. The conveying member 58 includes a rotating shaft 59 and spiral fins 62 that are fixed around the rotating shaft.

The conveying member 58 and cranks 61 are alternately connected to each other. The spiral fins 62 are fixed around the rotating shaft 59. The crank 61 is a mechanism including a shaft that is not formed on the extended line of the rotating shaft 59 and is positioned parallel to the rotating shaft 59 and a handle that connects the shaft to the rotating shaft 59.

The cranks 61 are disposed immediately below the waste toner collecting ports 57. Vertical slide members 63 are connected to the cranks 61. The vertical slide member 63 includes a cylindrical spiral body 64 and a crank connecting portion 65 that vertically extends from the lower portion of the spiral body 64.

Meanwhile, when the shape of each of the inner portions of the vertical belt-waste-toner conveying passage 32 and the vertical drum-waste-toner conveying passages 35 (35*y*, 35*m*, 35*c*, and 35*k*) is a columnar shape, the vertical slide member 63 includes the cylindrical spiral body 64 that has the shape of a three-dimensional curve rising in the direction perpendicular to the plane of rotation while rotating.

However, when the shape of each of the inner portions of the vertical belt-waste-toner conveying passage 32 and the vertical drum-waste-toner conveying passages 35 (35*y*, 35*m*, 35*c*, and 35*k*) is a prismatic shape, the spiral body 64 of the vertical slide member 63 may not have a cylindrical shape and may have a prismatic shape.

These vertical slide members 63 are inserted into the vertical drum-waste-toner conveying passage 35 and the vertical belt-waste-toner conveying passage 32. The outer diameter of the spiral body 64 is smaller than the diameter of the inner wall of the vertical drum-waste-toner conveying passage 35 or the vertical belt-waste-toner conveying passage 32.

That is, the outer diameter of the spiral body 64 is smaller than the diameter of the vertical drum-waste-toner conveying passage 35 or the vertical belt-waste-toner conveying passage 32 so that the spiral body 64 can substantially come into contact with the inner wall of the vertical drum-waste-toner conveying passage 35 or the vertical belt-waste-toner conveying passage 32. Specifically, the spiral body 64 is formed so as to have a gap of, for example, about 0.5 mm between itself and the inner wall of the vertical drum-waste-toner conveying passage 35 or the vertical belt-waste-toner conveying passage 32.

Further, the length of the spiral body 64 is smaller than a distance between the waste toner receiving port 52 and the waste toner collecting port 57 by a predetermined distance. This predetermined distance is set to be substantially equal to a vertical stroke of the crank 61. Furthermore, the spiral body 64 has flexibility so as to swing in all directions as a whole.

The waste toner conveying unit 50 includes the rotational drive gear 37 that is connected to the end portion of the rotating shaft 59 of the conveying member 58. When the rotational drive gear 37 rotates the rotating shaft 59, the cranks 61 and the vertical slide members 63 reciprocate in the vertical direction and the spiral bodies 64 of the vertical slide members 63 slide on the inner wall surfaces of the vertical belt-waste-toner conveying passage 32 and the vertical drum-waste-toner conveying passages 35 (35*y*, 35*m*, 35*c*, and 35*k*).

Therefore, each of the spiral bodies 64 thoroughly comes into slide contact with the entire inner wall of the first toner conveying passage that corresponds to the distance between the waste toner receiving port 52 and the waste toner collecting port 57. Accordingly, it is possible to easily scrape off waste toner, which has strong electric charges and adheres to the inner wall of the first toner conveying passage, with no waste toner that remains while adhering to the inner wall.

Further, since the spiral body 64 forms a cylindrical inner space and spiral portions are also wound with a sufficient gap interposed therebetween, the spiral body 64 allows waste toner, which free falls down from the waste toner receiving port 52, or waste toner, which is scraped off from the inner wall, to fall down to the waste toner collecting port 57 of the second toner conveying passage 33, which is provided on the lower side, without hindering the waste toner from falling down.

As described above, according to the embodiment of the invention, even though the waste toner, which is successively conveyed to a vertical free-falling conveying passage from a horizontal forcibly conveying passage by a screw, adheres to the inner wall of the conveying passage near a successive conveying port of the free-falling conveying passage due to strong charge, the waste toner is easily scraped off by the vertical slide member that moves up and down while being linked to the rotation of the rotating shaft in the horizontal waste-toner conveying passage. Accordingly, a waste toner pile is not formed. Meanwhile, the waste toner has been easily scraped off by the vertical slide member, which moves up and down while being linked to the rotation of the rotating shaft in the horizontal waste-toner conveying passage, in the embodiment of the invention, but it goes without saying that the use of the waste toner conveying unit may be applied to the conveyance of toner used for new print without being limited to the conveyance of waste toner.

In addition, the first toner conveying passage may not be plurality and the number of them may be one.

Since a waste toner pile is not formed in the waste-toner conveying passage as described above, the occurrence of an obstacle is reduced, maintenance is easy, and the life of the apparatus is lengthened. As a result, economic efficiency is improved.

Meanwhile, the inner wall near the waste toner receiving port 52 may be formed of a conductive film, the vertical slide member 63 may be formed of a conductive member, and the conductive film and the conductive member may be adapted to be connected to the ground side of the apparatus body 1 by ground wires so that the polarity of the charged waste toner is neutralized.

Some embodiments of the invention have been described, but the invention is included in inventions described in the claims and the equivalent scope thereof. Inventions, which are described in the original claims of this application, are added below.

INDUSTRIAL APPLICABILITY

The invention can be used for a waste toner conveying unit that collects waste toner discharged from a cleaner for a transfer belt and cleaners for photoreceptor drums of an image forming apparatus and efficiently conveys the waste toner to a waste toner storage container.

What is claimed is:

1. A toner conveying unit comprising:

a first toner conveying passage that includes a receiving port in an inner wall of the first toner conveying passage and that guides toner to fall down from the receiving port;

a second toner conveying passage that joins a lower portion of the first toner conveying passage through a toner collecting port;

a conveying member that is provided in the second toner conveying passage and that conveys the toner in a predetermined direction while rotating;

a crank that is provided in the second toner conveying passage below the first toner conveying passage and that is connected to the conveying member; and a vertical slide member that includes:

a crank connecting unit that is connected to the crank, and a spiral body that is inserted into the first toner conveying passage, and that is formed so as to come into slide contact with the inner wall of the first toner conveying passage, wherein a length of the spiral body is smaller than a distance between the receiving port and the toner collecting port.

2. The toner conveying unit according to claim 1, further comprising a driving source that is connected to the conveying member, wherein the conveying member is rotated by a driving force that is obtained from the driving source, wherein the crank and the vertical slide member reciprocate in a vertical direction, and wherein the vertical slide member slides on an inner wall surface of the first toner conveying passage so as to scrape off the toner.

3. The toner conveying unit according to claim 2, wherein the driving source includes a rotational drive gear.

4. The toner conveying unit according to claim 1, wherein the conveying member includes any one of a shape of a coil and a rotating shaft with spiral fins fixed to an outer peripheral surface of the rotating shaft.

5. The toner conveying unit according to claim 1, comprising a plurality of first toner conveying passages, wherein the plurality of first toner conveying passages include vertical drum-toner conveying passages that are disposed so as to correspond to drum cleaners for a plurality of photoreceptor drums, respectively and that guide toner discharged from the drum cleaners to the second toner conveying passage, and a vertical belt-toner conveying passage that guides toner discharged from a belt cleaner for a transfer belt to the second toner conveying passage.

6. The toner conveying unit according to claim 5, wherein the photoreceptor drums are provided in a cyan image forming unit, a magenta image forming unit, a yellow image forming unit, and a black image forming unit, respectively.

7. The toner conveying unit according to claim 1, wherein the conveying member, which includes a rotating shaft around which spiral fins are fixed, and a plurality of the cranks are alternately connected to each other, wherein the crank includes a shaft that is not formed on an extended line of the rotating shaft of the conveying member and that is positioned parallel to the rotating shaft, and wherein the crank includes a handle that connects the shaft to the rotating shaft.

8. The toner conveying unit according to claim 1, further comprising: a toner storage container that collects the toner conveyed through the second toner conveying passage in the predetermined direction.

9. The toner conveying unit according to claim 8, wherein the toner storage container is detachably provided.

10. The toner conveying unit according to claim 8, wherein toner, which passes through the first toner conveying passage and the second toner conveying passage, is waste toner, and toner stored in the toner storage container is waste toner.

11. The toner conveying unit according to claim 1, wherein the length of the spiral body is smaller than the distance between the receiving port and the toner collecting port, by a distance which is substantially equal to a vertical stroke of the crank.

* * * * *